US006152230A

United States Patent [19]

Edwards et al.

[11] Patent Number: 6,152,230

[45] Date of Patent: Nov. 28, 2000

[54] HIGH PRESSURE TREE CAP

[75] Inventors: Jeffrey Charles Edwards, Aberdeen; Michael Graham Morgan, Banff, both of United Kingdom

[73] Assignee: Expro North Sea Limited, United Kingdom

[21] Appl. No.: 09/125,858

[22] PCT Filed: Feb. 26, 1997

[86] PCT No.: PCT/GB97/00534

§ 371 Date: Aug. 26, 1998

§ 102(e) Date: Aug. 26, 1998

[87] PCT Pub. No.: WO97/33067

PCT Pub. Date: Sep. 12, 1997

[30] Foreign Application Priority Data

Mar. 7, 1996 [GB] United Kingdom ..... 9604803

[51] Int. Cl.[7] ..... E21B 33/035; E21B 47/06

[52] U.S. Cl. ..... 166/337; 166/368

[58] Field of Search ..... 166/337, 344, 166/348, 350, 368; 405/224.2, 224, 195.1, 204

[56] References Cited

U.S. PATENT DOCUMENTS 3,800,869 4/1974 Herd et al. ..... 166/337
4,691,781 9/1987 Gano ..... 166/368
4,887,672 12/1989 Hynes ..... 166/344
5,280,766 1/1994 Mohn ..... 166/368
5,366,017 11/1994 Voss, Jr. ..... 166/368
5,372,199 12/1994 Cegielski et al. ..... 166/368

*Primary Examiner*—Eileen D. Lillis
*Assistant Examiner*—Frederick L. Lagman
*Attorney, Agent, or Firm*—Gifford, Krass, Groh, Sprinkle, Anderson & Citkowski, P.C.

[57] ABSTRACT

A wellhead cap assembly (10) includes a high security barrier (16) for installation onto a wellhead (12) containing any leakage safely and for permitting the installation of a subsea xmas tree onto the wellhead (12) whilst, simultaneously, providing means for containing full pressure control during rectification of the leak. The barrier (16) is provided by an internal tree cap which allows pressure between the top of the tubing hanger (34) and the underside of the tree cap (16) to be monitored by pressure monitoring means (20) via a port (29) in the assembly (10) and, in addition, in the event the presence of well bore fluids is detected indicating that leakage has occurred, the cap assembly allows intervention in order to rectify the leakage.

9 Claims, 3 Drawing Sheets

HIGH PRESSURE TREE CAP

The present invention relates to well safety and, in particular, to safety of perforated and suspended wells in which are installed tubing hangers fitted with wireline plugs, but which do not have a xmas tree fitted.

At the end of the drilling phase of a production well, a tubing hanger may be run into the well, while the BOP stack and marine riser are still connected. The tubing hanger is landed, locked and then pressure tested. Downhole work may then occur to clean the well up and a brief well test may then be conducted. At the end of this phase the well is made safe prior to the disconnection and retrieval of the BOP stack and marine riser, to await the installation of a subsea xmas tree on some occasion in the future. The well is made safe by the installation of mechanical plugs with elastomeric seals deployed into the well using wireline techniques.

Within the production bore a primary barrier is established by the installation of a deep set plug in the downhole completion, at or below the packer assembly. A secondary barrier is established by the installation of a second similar plug within a suitable profile in the tubing hanger production bore. On the annulus side, the primary barrier is the downhole packer assembly and a secondary barrier is established by the installation of a similar wireline set plug in a separate profile of the annulus bore within the tubing hanger. Thus, the statutory requirement to provide two barriers between the reservoir and the environment are satisfied.

However, to date, the authority responsible for safety in the British sector of the North Sea, for the time being, the Health & Safety Executive (HSE), requires there to be a drilling facility on hand in the locality for the duration that a live well is suspended in this manner with a dual bore tubing hanger. The reason for this is that wireline set plugs have a poor record of reliability with the potential for such plugs to leak. Maintaining the presence of a drilling facility in the locality of such a suspended well enables the rig to stop its current activity and return to the suspended well with leaking plugs, re-run a BOP stack and perform the work necessary to stop the leakage. It will be appreciated that for field developments where such a drilling facility is on hand during the development of the field, no problem exists, the rig is in the area drilling other wells while previously drilled wells are suspended in this manner.

However, for small field developments, this requirement limits the opportunities to suspend wells in such a manner. It may not be possible to ensure the availability of a rig in close proximity to the suspended well for the period in which the well would be suspended, and it would not be cost effective to maintain a dedicated rig available in the locale until such time as subsea xmas trees are installed onto the suspended wells.

An object of the present invention is to obviate the requirement for a rig to be on hand in locales where there are suspended drilled wells.

A further object of the invention is to provide a barrier which can be coupled to the well to prevent leakage such that a drilling vessel is not required and which barrier can be easily removed to accommodate the installation of a subsea xmas tree.

This is achieved by providing an additional high security barrier installed onto the wellhead for containing any leakage safely and which permits the installation of a subsea xmas tree onto the wellhead whilst, simultaneously, providing means for containing full pressure control during rectification of the leak. The barrier includes means for monitoring the pressure between the upper surface of the tubing hanger and the underside of the barrier and, in addition, in the event the presence of well bore fluids is detected indicating that leakage has occurred, the barrier includes means to allow intervention in order to rectify the leakage.

According to a first aspect of the present invention there is provided a wellhead security system comprising, a wellhead cap assembly for fitting onto a wellhead, the wellhead having a tubing hanger assembly suspended therein, the tubing hanger assembly having plugs disposed in the production bore and the annulus bore, the wellhead cap assembly having a removable internal cap for providing an additional barrier to the tubing hanger plugs, a chamber defined between the internal cap and the top of the tubing hanger, and pressure monitoring means coupled to the tree cap assembly for monitoring pressure within said wellhead cap assembly indicative of the leakage of well fluid past the tubing hanger into said chamber.

Preferably, the wellhead cap assembly is dimensioned and proportioned to receive a blow-out preventer (BOP) stack and an internal tree cap retrieving tool moveable through the bore of said BOP stack for retrieving the internal tree cap from the cap assembly for replacement or restitution of the tubing hanger plugs, or other components which are found to have given rise to the leak.

Preferably also, the pressure monitoring means is integral with the tree cap assembly. Alternatively, the pressure monitoring means is separate from the tree cap assembly. Conveniently, the pressure monitoring means also includes vent means which is actuatable to vent excess fluid pressure from said chamber.

Preferably also, the pressure monitoring means includes a pressure monitoring bore which passes through the wall of the wellhead cap assembly by which fluid pressure can be monitored in said chamber.

According to another aspect of the present invention, there is provided a method of providing an additional safety barrier on a wellhead in which a tubing hanger is suspended with plugs therein, said method comprising the steps of, disposing a tree cap assembly on top of the wellhead and creating an additional barrier above the tubing hanger assembly, defining a chamber between the additional barrier and the top of the tubing hanger, and providing means for monitoring fluid pressure within said chamber indicative of leakage of wellhead fluid into said chamber past said tubing hanger set plugs.

Preferably also, said method includes the step of venting excess pressure from said chamber when said monitored pressure exceeds a predetermined value.

Preferably also, the method includes coupling a BOP stack to the wellhead cap assembly and providing tree cap retrieval means passing through the BOP stack for removing the additional barrier to repair or replace said tubing hanger set plugs in the event that leakage of well fluid is present.

These and other aspects of the present invention will become apparent from the following description when taken in combination with the accompanying drawings in which.

Figure 1:
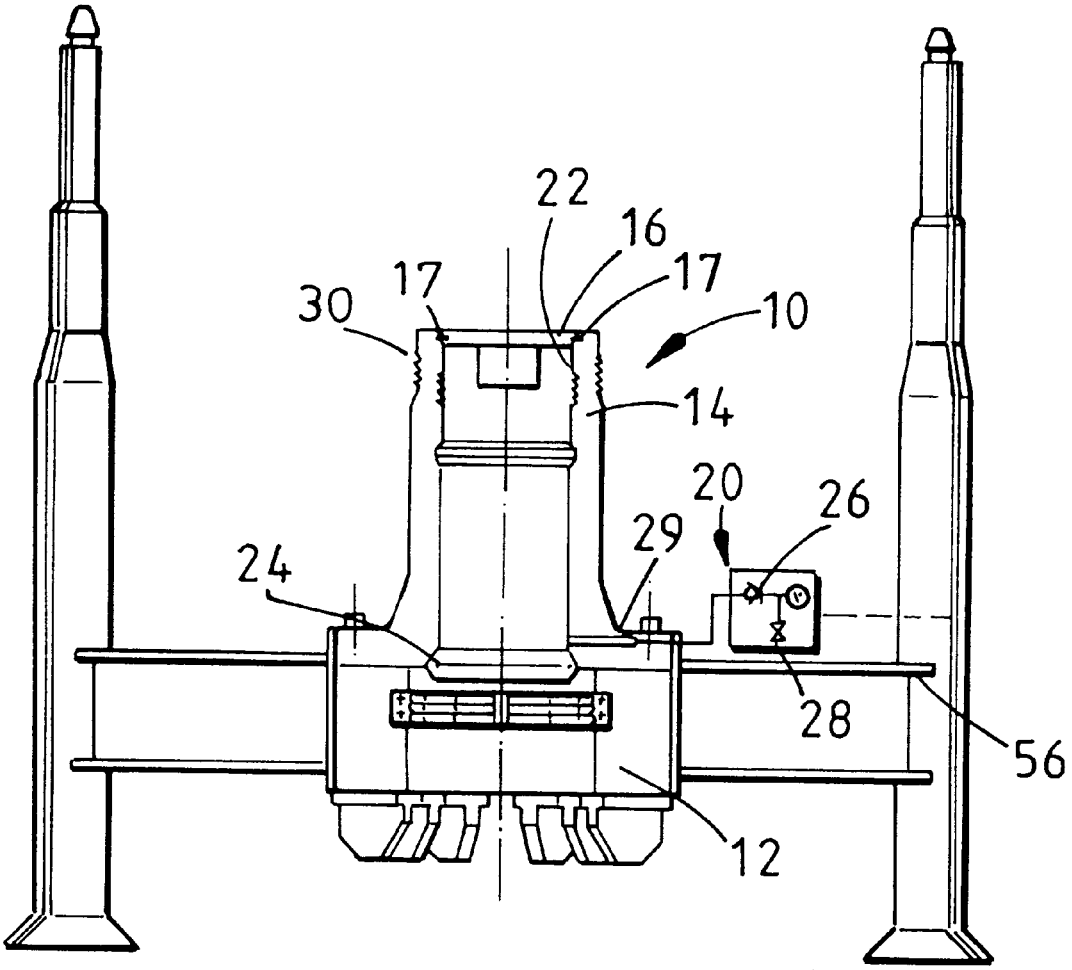
FIG. 1 is a diagrammatic elevational representation of a high pressure tree cap assembly in accordance with an embodiment of the present invention.

Reference is first made to FIG. 1 of the drawings which depicts a high pressure tree cap assembly generally indicated by reference numeral 10 which incorporates a completion spool assembly comprising a wellhead connector 12 with a 18¾" mandrel 14 attached to it at its upper surface, an internal tree cap 16 and a pressure gauge and vent facility, generally indicated by reference numeral 20. The upper area of the completion spool bore 22 accommodates the internal tree cap 16. A lower seal is established by a full bore metal seal 24 (AX/VX gasket) which is disposed between the mandrel 14 and the wellhead. Seals 17 located on the external surface of the internal tree cap 16 establish the upper seal between the tree cap 16 and the mandrel bore 22. By these means any leakage from tubing hanger plugs (not shown) is contained within the high pressure cap assembly 10. The high pressure gauge monitoring means 20 includes suitable isolating valves 26 and vent valves 28 which are provided to monitor the internal pressure in bore 22 through port 29 in the mandrel 14 within the high pressure cap 10, and the external top surface 30 of the mandrel provides a suitable proprietary profile (Vetco H4, Drillquip profile or clamp hub) onto which a BOP stack (not shown) may be attached for intervention purposes.

Figure 2:
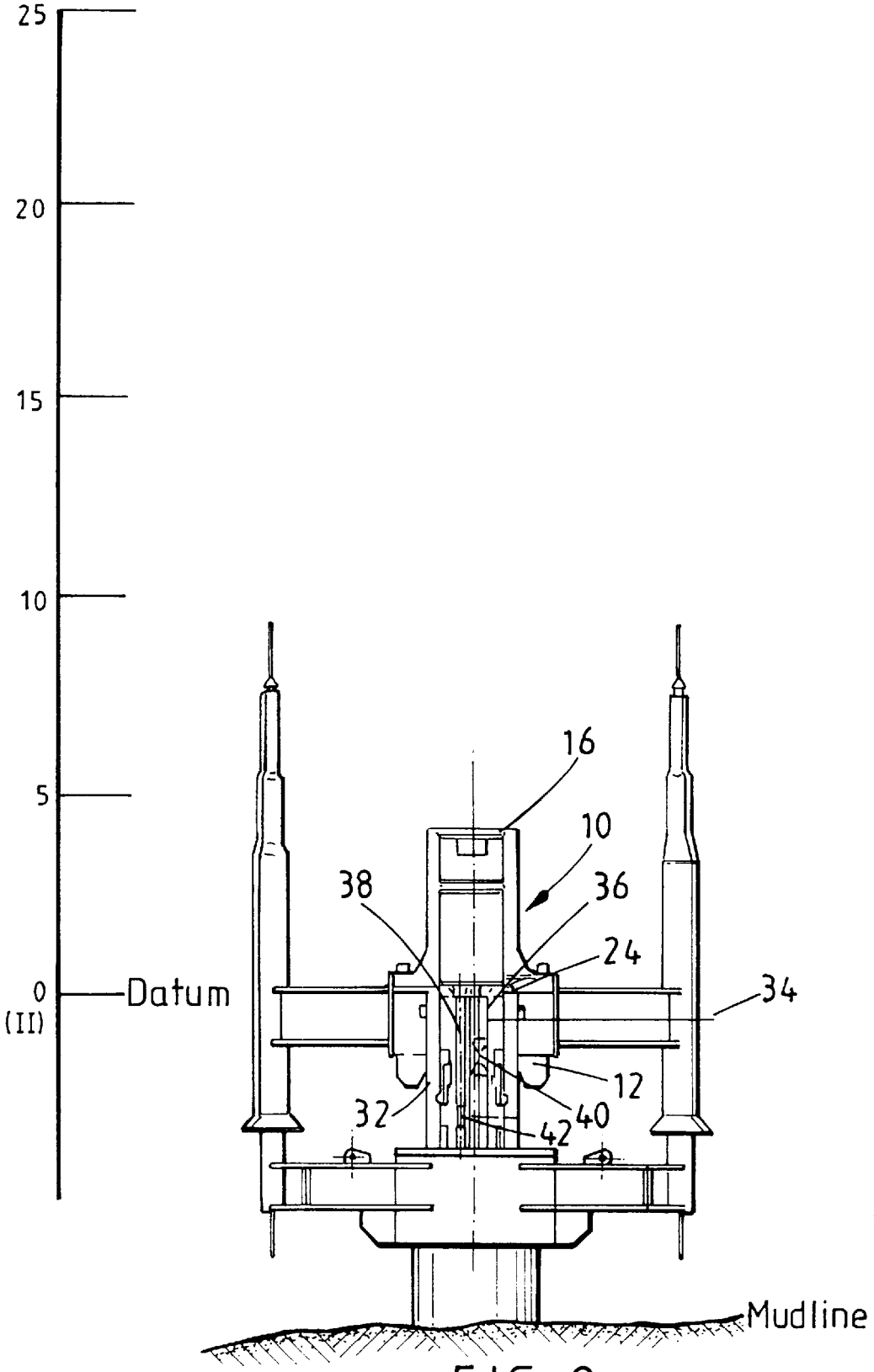
FIG. 2 is a view similar to FIG. 1 except that the high pressure cap assembly is shown installed on a well suspended with a dual bore tubing hanger.

Reference is now made to FIG. 2 of the drawings which depicts the high pressure cap assembly 10 located in position on a wellhead 32 in which a tubing hanger 34 is located, having a main production bore 36 and an annulus bore 38 into which tubing hanger wireline plugs 40 and 42 are disposed respectively. The wellhead 32 typically an 18¼" wellhead which mates with the internal diameter of the wellhead connector 12. It will be seen that, in use, the full bore metal seal 24 is located around the tubing hanger. The tree cap 16 is located above the top of the tubing hanger 34. In the event that there is fluid or gas leakage, past or through the tubing hanger 34, so that there is a pressure increase in the bore 22 between the upper surface of the tubing hanger and the underside of the tree cap 16, the pressure therein can be monitored via port 29 using the pressure gauge and vent facility 20 (FIG. 1). If there is excess pressure, the vent valve 28 can be actuated to vent the internal pressure from the high pressure cap assembly 10.

Figure 3:
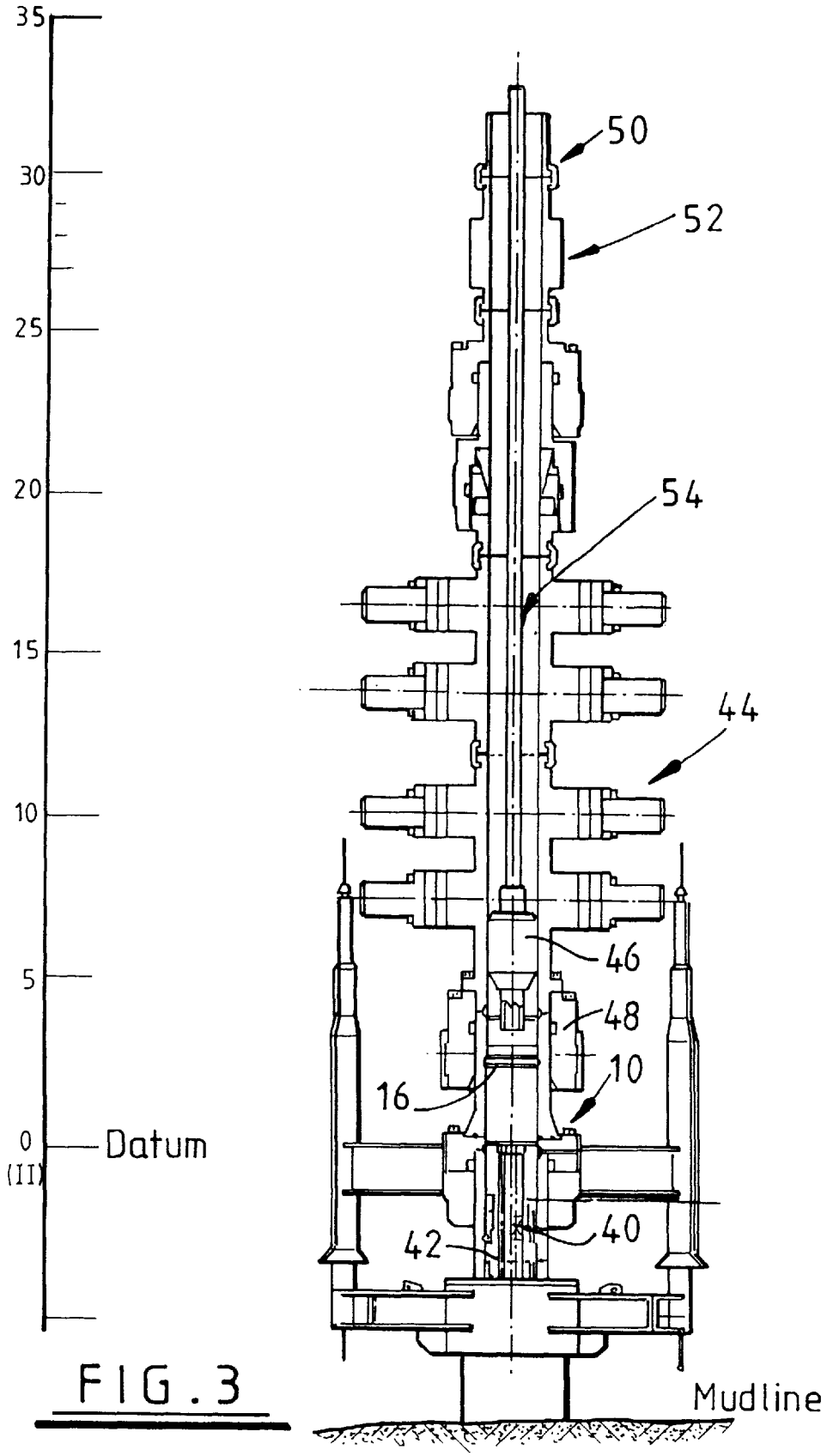
FIG. 3 shows a BOP stack installed on the high pressure cap assembly with a tool deployed for the retrieval of the internal tree cap.

Reference is now made to FIG. 3 of the drawings which depicts a BOP stack, generally indicated by reference numeral 44, attached to the high pressure cap assembly 10 with a tool 46 deployed for the retrieval of the internal tree cap 16. In addition to the parts shown and described in FIGS. 1 and 2, it will be seen that the BOP connector 48 of BOP stack fits over the mandrel 14 and the high pressure cap assembly 10. It will also be seen that the BOP stack 44 is coupled to a marine riser 50 via a flex joint 52. Within the bore 54 of the BOP stack and marine riser is the internal tree cap deployment tool 46 which allows the tree cap 16 to be retrieved to allow replacement or rectification of the tubing hanger plugs 40,42. Once the internal tree cap 16 has been retrieved, a tool for intervening on the tubing hanger (not shown) may then be run on dual bore riser (not shown) and any leakage at the plugs 40,42 may be rectified with the aid of wireline techniques as is currently common practice.

Various modifications may be made to the embodiment hereinbefore described without departing from the scope of the invention. For example, the full bore metal seal 24 may be replaced by any other suitable seal; it does not have to be metal. In addition, it will be understood that the size of the cap assembly can be varied to suit various wellhead sizes, although 18¾" H4 (or CIW) connectors are most common. Similarly, the mandrel profile can be varied to suit various sizes of BOP stacks, although the 18¾" mandrel H4 (or CIW) profile is the most common. The pressure gauge and vent facility 20 can be coupled to the cap assembly 10 or can be separate and coupled to the guide frame. If separate, it can be coupled to the tree cap assembly 10 when installed as shown in FIG. 1. It will be understood that the tree cap assembly 10 has applications with conventional subsea test tree and tubing hanger running tools and not only the 5"×2" completion subsea test tree, although it should be understood that the use of the 5"×2" completion subsea test tree offers a number of advantages which are documented in applicant's co-pending Application No. 9509547.7. The tubing hanger may also be of a design different from the dual bore type, but in all cases there will be a production bore which may be isolated by means of wireline plugs. The bore referred to as production may also be designated for the injection of either water or gas into a reservoir.

The principal advantage of the present invention is that a tertiary barrier is provided to contain any leakage through the first and secondary barriers. In addition, the cap assembly allows the monitoring of pressure between the upper surface of the tubing hanger and the underside of the extra barrier. A single bore or multiple bores may pass through the wall of the wellhead assembly for monitoring pressure, or this can be provided by a single bore to monitor pressure and a separate vent bore which has a valve activated by the pressure measured to vent excess pressure from inside the assembly. Furthermore, in the event that wellbore fluids are detected within this space, indicating a leakage has occurred, intervention can be required to rectify the leakage. The cap assembly simultaneously provides facility for attachment of a suitable means or maintaining full pressure control during rectification of the leak by allowing a BOP stack to be coupled to the top of the cap assembly. In addition, once the well is secured against leaks, the barrier may be removed immediately prior to the removal of the BOP stack and the installation of a subsea xmas tree, thereby providing security against leaks during the period of well suspension. Accordingly, this provides the significant advantage that the presence of the drilling facility in the locality while the well is suspended is not required.

What is claimed is:

1. A wellhead security system comprising, a wellhead cap assembly for fitting onto a wellhead, the wellhead having a tubing hanger assembly suspended therein, the tubing hanger assembly having plugs disposed in a production bore and an annulus bore, the wellhead cap assembly having a removable internal cap for providing an additional barrier to the tubing hanger plugs, a chamber defined between the internal cap and a top of the tubing hanger assembly, and pressure monitoring means coupled to the wellhead cap assembly for monitoring pressure within said wellhead cap assembly indicative of leakage of well fluid past the tubing hanger assembly into said chamber.

2. A system as claimed in claim 1 wherein the wellhead cap assembly is dimensioned and proportioned to receive a blow-out preventer (BOP) stack and an internal cap retrieving tool moveable through a bore of said BOP stack for retrieving the internal cap from the cap assembly for replacement or restitution of the tubing hanger plugs.

3. A system as claimed in claim 1 wherein the pressure monitoring means is integral with the cap assembly.

4. A system as claimed in claim 1 wherein the pressure monitoring means is separate from the cap assembly.

5. A system as claimed in claim 1 wherein the pressure monitoring means includes vent means which is actuatable to vent excess fluid pressure from said chamber.

6. A system as claimed in claim 1 wherein the pressure monitoring means includes a pressure monitoring bore which passes through a wall of the wellhead cap assembly by which fluid pressure can be monitored in said chamber.

7. A method of providing an additional safety barrier on a wellhead in which a tubing hanger is suspended with plugs therein, said method comprising the steps of, disposing a tree cap assembly on top of the wellhead and creating an additional barrier above the tubing hanger assembly, defining a chamber between the additional barrier and a top of the tubing hanger, and providing means for monitoring fluid pressure within said chamber indicative of leakage of wellhead fluid into said chamber past said tubing hanger plugs.

8. A method as claimed in claim 7 wherein said method includes the further step of venting excess pressure from said chamber when said monitored pressure exceeds a predetermined value.

9. A method as claimed in claim 7 including the further steps of coupling a BOP stack to the tree cap assembly and providing tree cap retrieval means for passing through the BOP stack for removing the additional barrier to repair or replace said tubing hanger plugs in the event that leakage of well fluid is present.

* * * * *